US009055802B2

(12) United States Patent
McDonnell

(10) Patent No.: US 9,055,802 B2
(45) Date of Patent: Jun. 16, 2015

(54) PROGRESSIVE COMB FOR HAIRCUT FADING

(71) Applicant: Jillian McDonnell, Pembroke, NH (US)

(72) Inventor: Jillian McDonnell, Pembroke, NH (US)

( * ) Notice: Subject to any disclaimer, the term of this patent is extended or adjusted under 35 U.S.C. 154(b) by 0 days.

(21) Appl. No.: 13/737,943

(22) Filed: Mar. 19, 2013

(65) Prior Publication Data

US 2014/0283867 A1 Sep. 25, 2014

(51) Int. Cl.
*A45D 24/36* (2006.01)

(52) U.S. Cl.
CPC ..... *A45D 24/36* (2013.01)

(58) Field of Classification Search
CPC ..... A45D 24/36
USPC ..... 132/213.1, 219, 126, 137, 140, 142, 132/150, 120; D28/21, 28, 30
See application file for complete search history.

(56) References Cited

U.S. PATENT DOCUMENTS

| | | | | |
|---|---|---|---|---|
| 2,589,469 | A * | 3/1952 | Zerbo | 132/219 |
| 3,645,321 | A * | 2/1972 | Robinson | 164/509 |
| 6,367,422 | B1 * | 4/2002 | Wilhelmi | 119/625 |
| 2009/0314304 | A1 * | 12/2009 | Jochim et al. | 132/126 |
| 2012/0192427 | A1 * | 8/2012 | Hazard | 30/30 |

* cited by examiner

*Primary Examiner* — Rachel Steitz
(74) *Attorney, Agent, or Firm* — Brian J. Colandreo; Michael T. Abramson; Holland & Knight LLP

(57) ABSTRACT

An apparatus for a "V" shaped comb. The comb gradually gets thicker from bottom to top. This comb is somewhat intended to be used like a traditional comb; however, the width of the comb keeps the hair spaced evenly to ensure a blended fade haircut. The sporadic teeth keep the hair in place while the trimmers cut the hair following the edge guide provided on the comb. This tool gives the stylist (user) the flexibility to provide a shorter fade or longer fade by adjusting the comb up or down on the head.

22 Claims, 7 Drawing Sheets

400

200

300

400

500

600

PROGRESSIVE COMB FOR HAIRCUT FADING

FIELD OF THE DISCLOSURE

Embodiments of the invention relate generally to hair cutting clippers used in fading haircuts. More particularly, combs that get progressively thicker to ensure even fade cutting techniques with trimmers or scissors.

BACKGROUND OF THE DISCLOSURE

The inventor is a hair stylist, specializing in men's haircuts. Many clients request a fade along the side and back, meaning that the hair on the side and back of the head is gradually longer than the hair on the bottom. The traditional way to provide the requested cut is to use clippers with different guards along the bottom, middle, and top. Some fades require more guards which consumes more time on the haircut for only the side of the head. By using the traditional clippers and guards, it may cause lines in the hair which are unattractive and look unprofessional. A lot of new hair stylists or uneasy stylists may leaves lines of demarcation in the hair and this product prevents this from happening.

BRIEF SUMMARY OF DISCLOSURE

Embodiments of the current invention relate to hair cutting tools that get progressively thicker from bottom to top (as seen at least in view 400 in FIG. 4), and primarily used with trimmers or scissors. Current combs have an even thickness from top to bottom, leaving the haircut fade up to the user. Without professional cosmetology or barber skills, the room for error is high. The invention allows the user to choose the thickness of the fade by sliding the comb up or down on the clients head, while providing an even surface to cut hair quickly and easily.

This hair cutting tool provides an even fade to customers, typically male, and ease of use to users by utilizing the "teeth" of the comb that gradually gets thicker towards the top of the comb. The handle provides ease of maneuvering throughout the side of the head (as seen at least in FIG. 1).

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
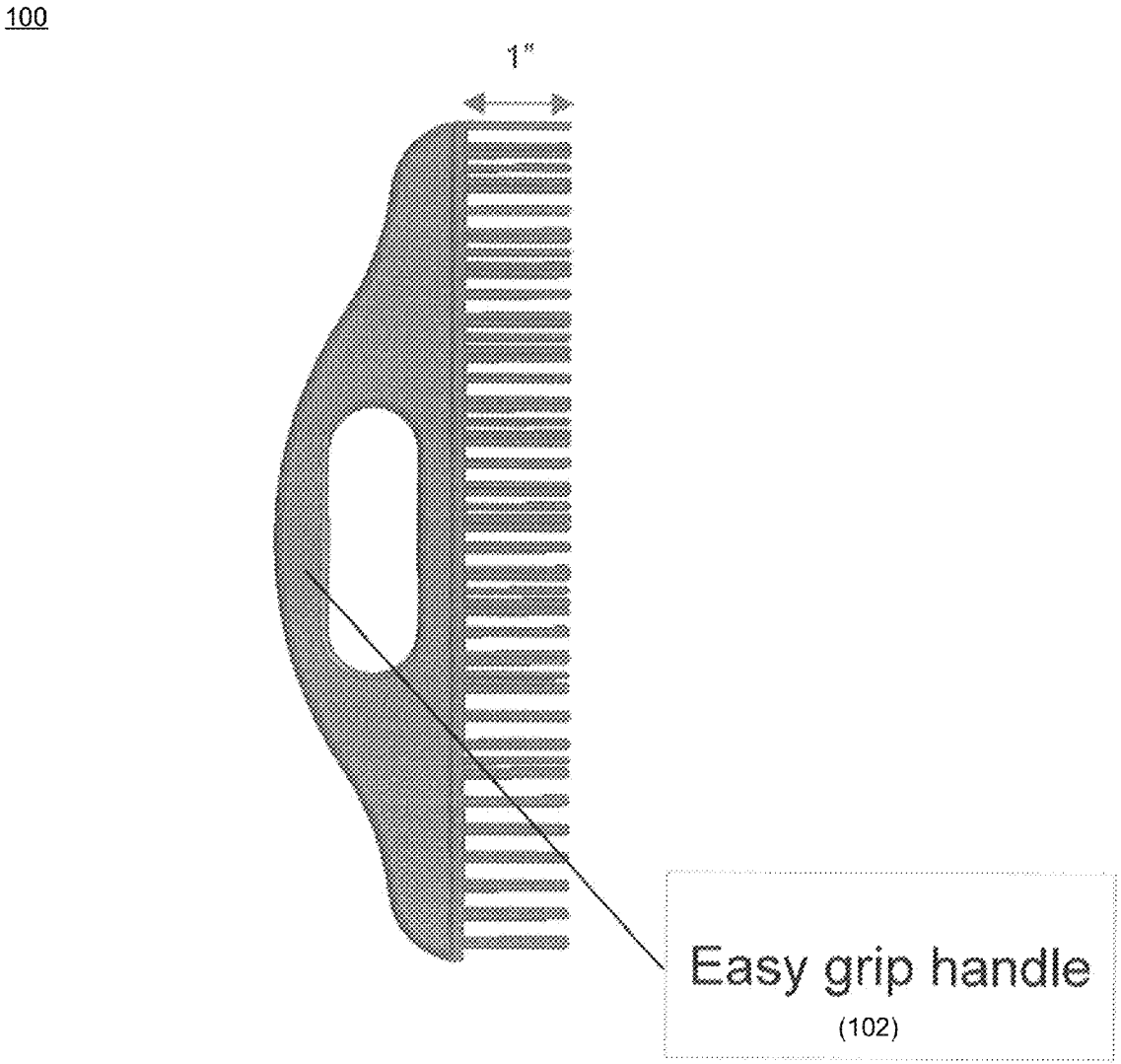
FIG. 1 is an illustrative diagrammatic view of an easy grip handle and one inch long comb teeth according to one or more implementations of the present disclosure.
Figure 2:
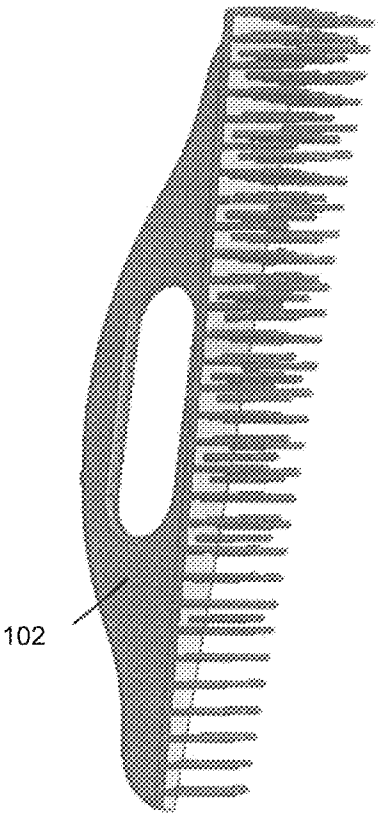
FIG. 2 is an illustrative diagrammatic view of an easy grip handle and starts to show the "V" shape of comb according to one or more implementations of the present disclosure.
Figure 3:
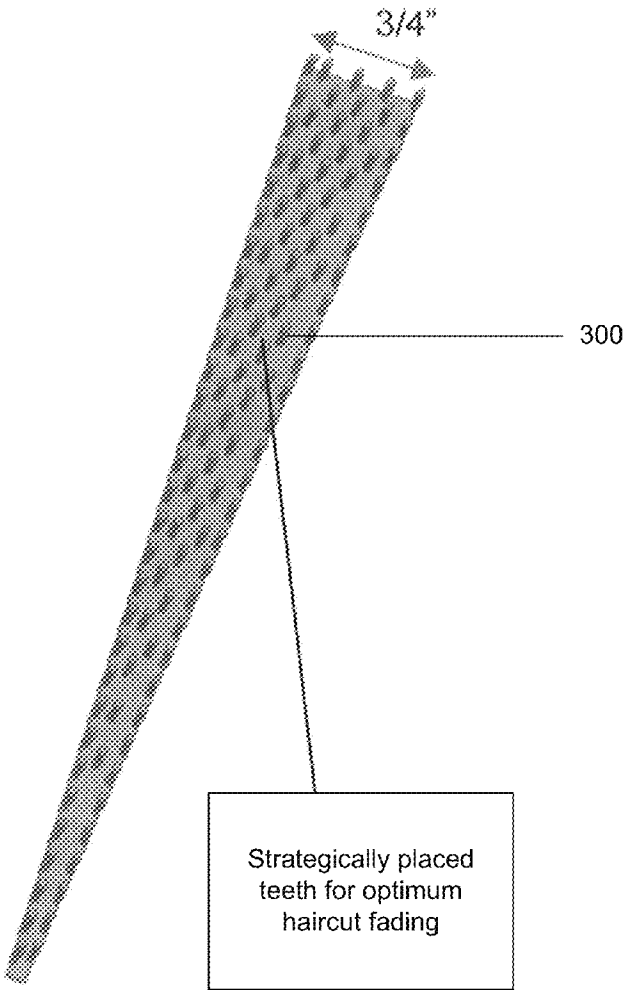
FIG. 3 is an illustrative diagrammatic view of a top length at ¾" and descends to ⅛". The unique "V" shape is what makes the hair fade without using clippers and provides a seamless fade according to one or more implementations of the present disclosure.
Figure 4:
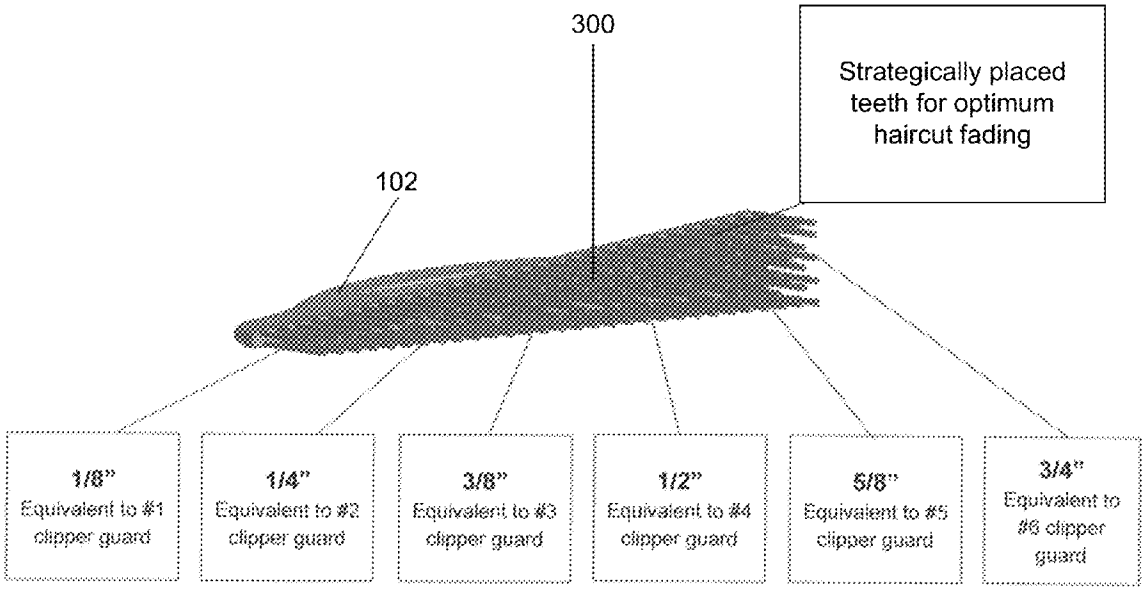
FIG. 4 is an illustrative diagrammatic view of descending lengths of the comb according to one or more implementations of the present disclosure.

Referring at least to FIGS. 1-7, the inventor saw the above problem and invented the Fade Perfect Comb (e.g., comb 100) which is a "V" shaped comb that gradually gets thicker from bottom to top (as seen at least in view 300 in FIG. 3). This comb is somewhat intended to be used like a traditional comb; however, the width of the comb keeps the hair spaced evenly to ensure a blended fade haircut. The sporadic teeth (e.g., teeth 300) keep the hair in place while the trimmers cut the hair following the edge guide provided on the comb (as seen at least in view 600 in FIG. 6 and in view 700 in FIG. 7). This tool gives the stylist (user) the flexibility to provide a shorter fade or longer fade by adjusting the comb up or down on the head.

Conventional hair clippers with numerous size guards are useful; however, the Fade Perfect Comb provides a quicker, easier way to provide the same haircut in less time and with less work involved. In addition to the Fade Perfect Comb's usefulness, this tool is less expensive to manufacture and is completely safe for users and customers.

This comb was made to minimize cutting time as well as clean up the neckline and sideburns without the worry of lines of demarcation. A lot of beginner hairstylists and home users are typically not confident in using clippers with children or even adult men and women. This comb was invented to make a seamless fade without worry.

A "fade" haircut is commonly known as the haircut style on the side and back of the head with the hair towards the top of the head being longer than the bottom of the head. The fade consists of different hair lengths gradually getting shorter toward the bottom of the head. Traditional means of applying this haircut uses clippers with different size guards throughout the side and back of the head, making sure that there are no lines of demarcation in the hair.

The purpose of the Fade Perfect Comb is to provide the perfect fade, being adjustable to the hair stylist, customer, or user, as well as reducing the amount of time spent providing a fade style haircut on the side and back of the head. The Fade Perfect Comb provides this haircut in one fashion without having to change multiple guards on the clippers when fading hair. By having the comb go from thin at the bottom to thick at the top, it prevents any possible lines that may happen with traditional clippers with guards or free-hand cutting with a regular comb. This invention is unlike a traditional comb because its width is thinner at the bottom and gradually gets thicker at the top which allows the user to cut the hair at desired length by using trimmers only, no guards or clippers. This saves a significant amount of time for the user, utilizing only one tool as opposed to many.

This invention is not intended to be used at the top of the head. Beyond the length of ¾" at the thickest point (as seen at least in view 400 in FIG. 4), the top of the head can be done by finger length and scissors, scissors over comb or clippers to desired top hair length. The Fade Perfect Comb is invented to fade the hair from nape, around the ears and to about the occipital bone on the head (temple area, around head). This is for quick, evenly cut fades, a simple clean up around the hairline, ears and sideburns without the need of cutting the whole head of hair.

Use the Fade Perfect Comb like a traditional comb for a fade haircut, except users will lift hair within the tool and slide trimmers up the adjacent side of the comb (edge guide) where the hair can be cut. Users hold the comb by the handle (e.g., handle 102) whether you are left or right handed. You start by determining how long you want the hair to be from bottom to top. You start at the nape of the neck and work your way up. You hold the comb at desired length around the hairline. You take the hair trimmers and go up the length of the comb that is flat against the head by following the edge guide on the side of the comb (as seen at least in FIG. 7). When you are ready to cut further up on the head, just simply comb the hair that is against the higher part of the head and use the trimmers as before. By using the graduating comb, it prevents any line of demarcation as well as cleans up the neckline, sideburns, eyebrows and behind the ears. This comb is not intended to be used at the top of the head. That is where you would use one length on the top of the head with traditional clippers or finger length with scissors. This comb will come with picture instructions on how to be used properly.

Figure 5:
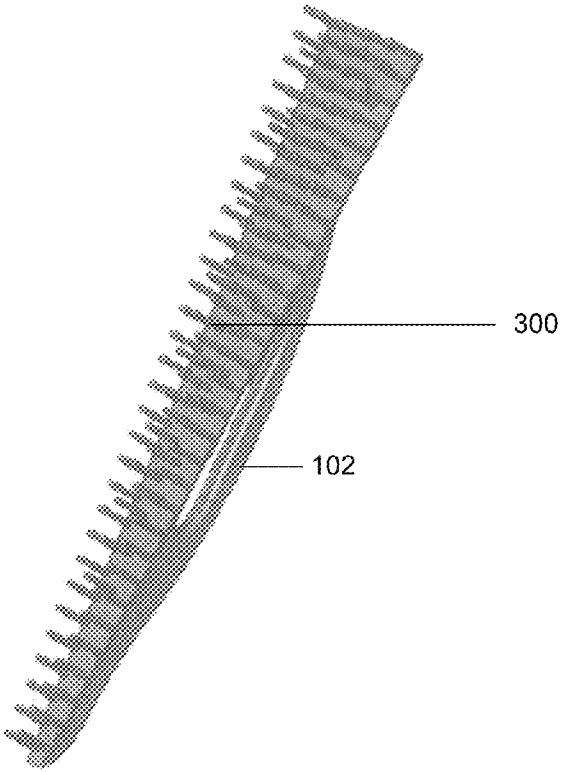
FIG. 5 is an illustrative diagrammatic view of a side view of the comb with strategic comb teeth placement according to one or more implementations of the present disclosure.
Figure 6:
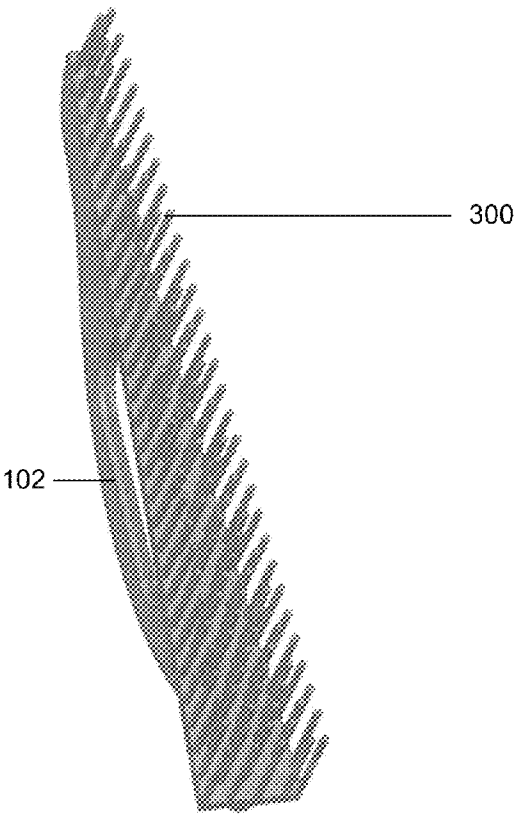
FIG. 6 is an illustrative diagrammatic view of an upside down side view of the comb according to one or more implementations of the present disclosure.
Figure 7:
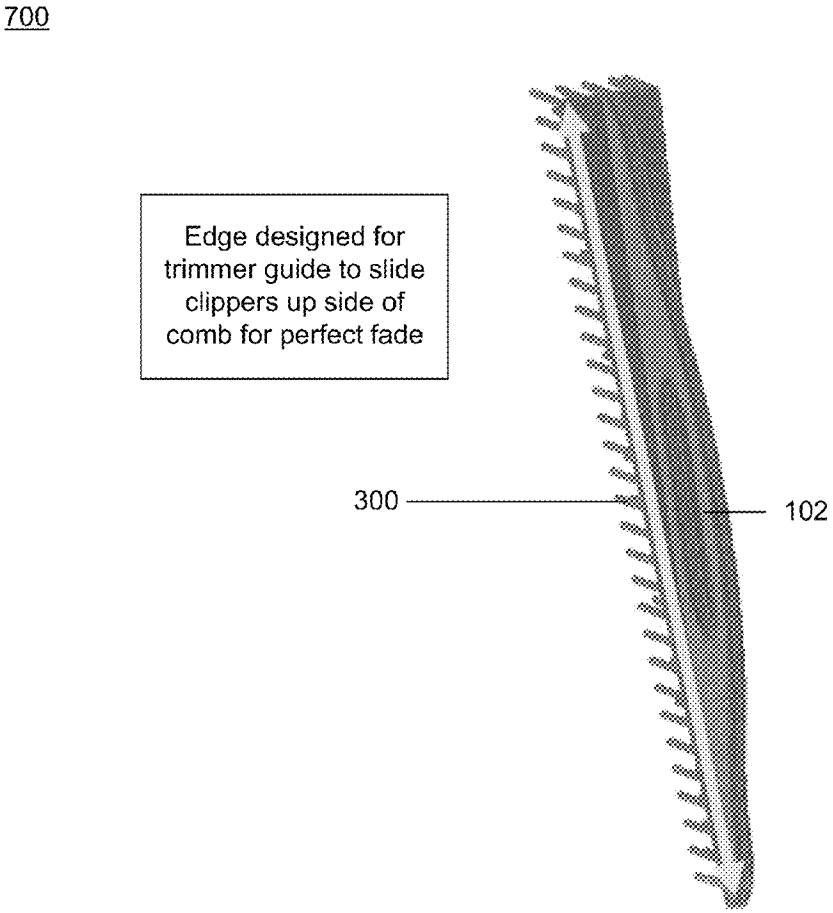
FIG. 7 is an illustrative diagrammatic view of an edge designed for the clippers to glide along for even hair cutting according to one or more implementations of the present disclosure.

The Fade Perfect Comb differs from a standard comb by gradually increasing in thickness towards the top of the comb (as seen at least in view 500 in FIG. 5). This allows the user to comb and cut the hair from the bottom of the head to the sides of the head. Typically used on male haircuts, this tool is made for ease of use in fading hair, using only the Fade Perfect Comb and trimmers.

By the comb descending in length, the handle being left or right handed, and the teeth being spaced evenly (as seen at least in view 200 in FIG. 2), it cuts the hair to the length desired without any lines of demarcation and essentially is mistake proof. It works by sliding the trimmers from the shortest length desired up to the longest length desired for that section. Once that is cut, you move the comb over to just about where you have already cut to find your "guide." The guide allows you to see where you ended and where to begin for the next cut. As you continue to follow your guide, you follow the hairline, from the nape of the neck to over the ears and to the side burns.

The terminology used herein is for the purpose of describing particular implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents of all means or step plus function elements that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, and any combinations thereof will be apparent to those of ordinary skill in the art without departing from the scope and spirit of the disclosure. The implementation(s) were chosen and described in order to best explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, and combinations thereof) are possible without departing from the scope of the disclosure defined in the appended claims.

The invention claimed is:

1. A comb comprising:

a frame, wherein the frame extends lengthwise from a first end to a second end, and wherein the first end of the frame is thinner than the second end of the frame to form a V shaped frame; and a plurality of teeth coupled to the V shaped frame, wherein at least a portion of the plurality of teeth span lengthwise from the first end to the second end and extend from the V shaped frame, wherein wider portions of the V shaped frame towards the second end include a higher number of adjacent teeth of the plurality of teeth than thinner portions of the V shaped frame towards the first end, and wherein changes of a width between the wider portions and the thinner portions of the V shaped frame are equivalent to a respective size setting of a plurality of size settings of a clipper guard, wherein at least a portion of the width of the V shaped frame is ⅛ inches for at least one of the respective size settings.

2. The comb of claim 1 wherein at least a portion of the plurality of teeth are spaced differently.

3. The comb of claim 1 further comprising a flat guiding wall along a side of the frame separating the plurality of teeth from a handle coupled behind the frame.

4. The comb of claim 1 wherein the comb is a single piece of material.

5. The comb of claim 4 wherein the material includes plastic.

6. The comb of claim 1 further comprising a handle coupled behind the frame.

7. The comb of claim 1 wherein at least a second portion of the width of the V shaped frame is ¼ inches for at least one of the respective size settings.

8. The comb of claim 1 wherein at least a second portion of the width of the V shaped frame is ⅜ inches for at least one of the respective size settings.

9. The comb of claim 1 wherein at least a second portion of the width of the V shaped frame is ½ inches for at least one of the respective size settings.

10. The comb of claim 1 wherein at least a second portion of the width of the V shaped frame is ⅝ inches for at least one of the respective size settings.

11. The comb of claim 1 wherein at least a second portion of the width of the V shaped frame is ¾ inches for at least one of the respective size settings.

12. The comb of claim 1 wherein at least a a second portion of the width of the V shaped frame is ¼ inches for at least one of the respective size settings, at least a third portion of the width of the V shaped frame is ⅜ inches for at least one of the respective size settings, at least a fourth portion of the width of the V shaped frame is ½ inches for at least one of the respective size settings, at least a fifth portion of the width of the V shaped frame is ⅝ inches for at least one of the respective size settings, and at least a sixth portion of the width of the V shaped frame is ¾ inches for at least one of the respective size settings.

13. A comb comprising:

a frame, wherein the frame extends lengthwise from a first end to a second end, and wherein the first end of the frame is thinner than the second end of the frame to form a V shaped frame; and a plurality of sections of a plurality of teeth between the first end of the V shaped frame and the second end of the V shaped frame, wherein each respective section width of the plurality of sections is equivalent to a respective size setting of a plurality of size settings of a clipper guard, wherein a width of at least one section of the plurality of sections is ⅛ inches for at least one of the respective size settings.

14. The comb of claim 13 further comprising a flat guiding wall along a side of the frame separating the plurality of teeth from a handle coupled behind the frame.

15. The comb of claim 13 further comprising a handle coupled behind the frame.

16. The comb of claim 13 wherein a second width of at least one section of the plurality of sections is ¼ inches for at least one of the respective size settings, a third width of at least one section of the plurality of sections is ⅜ inches for at least one of the respective size settings, a fourth width of at least one section of the plurality of sections is ½ inches for at least one of the respective size settings, a fifth width of at least one section of the plurality of sections is ⅝ inches for at least one of the respective size settings, and a sixth width of at least one section of the plurality of sections is ¾ inches for at least one of the respective size settings.

17. The comb of claim 13 wherein the comb is a single piece of material.

18. The comb of claim 13 wherein a second width of at least one section of the plurality of sections is ¼ inches for at least one of the respective size settings.

19. The comb of claim 13 wherein a second width of at least one section of the plurality of sections is ⅜ inches for at least one of the respective size settings.

20. The comb of claim 13 wherein a second width of at least one section of the plurality of sections is ½ inches for at least one of the respective size settings.

21. The comb of claim 13 wherein a second width of at least one section of the plurality of sections is ⅝ inches for at least one of the respective size settings.

22. The comb of claim 13 wherein a second width of at least one section of the plurality of sections is ¾ inches for at least one of the respective size settings.

* * * * *